US006192965B1

(12) United States Patent
Hinds

(10) Patent No.: US 6,192,965 B1
(45) Date of Patent: Feb. 27, 2001

(54) ZIPPERED SHOWER CURTAIN

(76) Inventor: Charles E. Hinds, P.O. Box 124, Tallula, IL (US) 62688

( * ) Notice: Subject to any disclaimer, the term of this patent is extended or adjusted under 35 U.S.C. 154(b) by 0 days.

(21) Appl. No.: 09/443,258

(22) Filed: Nov. 22, 1999

(51) Int. Cl.[7] ..... A47H 1/00
(52) U.S. Cl. ..... 160/330; 160/DIG. 6
(58) Field of Search ..... 160/330, 368.1, 160/350, 382, DIG. 6, DIG. 18; 24/399, 400, 403; 16/87.2, 87.4

(56) References Cited

U.S. PATENT DOCUMENTS

| | | | | |
|---|---|---|---|---|
| 2,613,368 | * | 10/1952 | Rosnebaum | 160/DIG. 6 X |
| 2,752,993 | * | 7/1956 | Scott | 160/330 |
| 2,771,945 | * | 11/1956 | Wittrup | 160/DIG. 6 X |
| 4,054,703 | * | 10/1977 | Boehm | 160/330 X |
| 4,154,542 | * | 5/1979 | Rasmason | 401/7 |
| 5,020,194 | * | 6/1991 | Herrington et al. | 24/400 |
| 5,109,912 | | 5/1992 | Gary | 163/330 |
| 5,191,922 | | 3/1993 | Wade | 160/124 |
| 5,339,884 | * | 8/1994 | Angerman | 160/DIG. 6 X |
| 5,586,375 | * | 12/1996 | Cooperman et al. | 160/330 X |
| 5,651,407 | | 7/1997 | Perez | 160/330 |
| 5,787,954 | * | 8/1998 | Herrera | 160/DIG. 6 X |
| 5,894,642 | | 4/1999 | Eberhardt | 24/716 |
| 6,041,454 | * | 3/2000 | Summerford | 160/DIG. 6 X |

* cited by examiner

*Primary Examiner*—Bruce A. Lev
(74) *Attorney, Agent, or Firm*—Mark E. Wiemelt

(57) ABSTRACT

A zippered shower curtain (10) comprising a valance (12), a curtain (14), and a zipper (16). The valance (12) includes a plurality of spaced apart apertures (22) allowing for suspension of the valance (12) from a horizontally disposed rod (28) by rings (24) or hooks (26). The curtain (14) is removably attached to the valance (12) by the zipper (16) allowing for the easy attachment or detachment of the curtain (14) from the valance (12) by the engagement or disengagement of the zipper teeth (32).

2 Claims, 2 Drawing Sheets

ZIPPERED SHOWER CURTAIN

BACKGROUND OF THE INVENTION

1. Field of the Invention

The present invention relates to a new and improved shower curtain. More specifically, the invention is directed to a shower curtain which is removably attached to a valance by a zipper. The valance is attached to and suspended from a horizontal rod in a shower stall or facility by rings or hooks which pass through apertures in the valance.

2. Description of the Related Art

Numerous inventions have heretofore been proposed which include curtains that are easy to hang and to remove. However, each of the prior art inventions have been found wanting in one or more particulars. In particular, these inventions have employed cooperating strips of hook and loop material (e.g., VELCRO™) which secure a curtain to a hanger device. Although hook and loop material is easily attachable and detachable, it lacks strength. If too much force is applied in pulling on a curtain which is attached to a hanger by hook and loop material, the hook and loop material can detached from each other, causing the unwanted removal of the curtain. This can especially be a problem for a shower curtain because the user pulls on the curtain in order to open or close it. In addition, in many of these prior art devices, snaps are used for the attachment of the curtain to the hanger. However, snaps have many drawbacks. Attaching a curtain to a hanger using snaps can be time consuming because a user must find the corresponding snap hole for each snap. Additionally, snaps may be difficult for people with arthritis to use.

Hence, there is a need in the art for a shower curtain which is easily attached and removed from a valance. There is also a need in the art for a shower curtain which is securely attached to a valance.

It is a primary object of the present invention to provide a new and improved zippered shower curtain.

A further object of the present invention is to provide a shower curtain which is easily removable from a valance.

Another object of the instant invention is to provide a shower curtain which is easily attachable to a valance.

A further object of the present invention is to provide a zippered shower curtain in which the shower curtain is securely attached to a valance.

Another object of the instant invention is to provide a zippered showered curtain in which the zipper is made of plastic so that it does not rust.

A further object of the present invention is to provide a zippered shower curtain which is convenient to use It is therefore an object of the present invention to provide an improved zippered shower curtain which has all the advantages of the prior art and none of its disadvantages.

These together with other objects of the invention, along with the various features of novelty which characterize the invention, are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated a preferred embodiment of the invention.

SUMMARY OF INVENTION

A broad aspect of the invention comprises a zippered shower curtain. One embodiment of the invention utilizes a zippered shower curtain which comprises a valance, a curtain, and a zipper which removably attaches the curtain to the valance. The valance, the curtain, and the zipper are generally commensurate in length with each other. The valance includes a plurality of spaced apart apertures proximate to the top edge of the valance. The valance is attached to and suspended from a horizontal rod by a plurality of rings which pass though the apertures.

Further embodiments of the invention will be discussed hereafter. In other embodiments of the present invention, the zipper is made of plastic. In another embodiment of the present invention, hooks are used as the attachment means to attach the valance to the horizontal rod.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

BRIEF DESCRIPTION OF THE SEVERAL VIEWS OF THE DRAWINGS

The foregoing and other additional objects of the present invention will be readily appreciated by those skilled in the art upon gaining an understanding of the invention as described in the following detailed description and shown in the accompanying drawings in which.

DETAILED DESCRIPTION OF THE INVENTION

Figure 1:
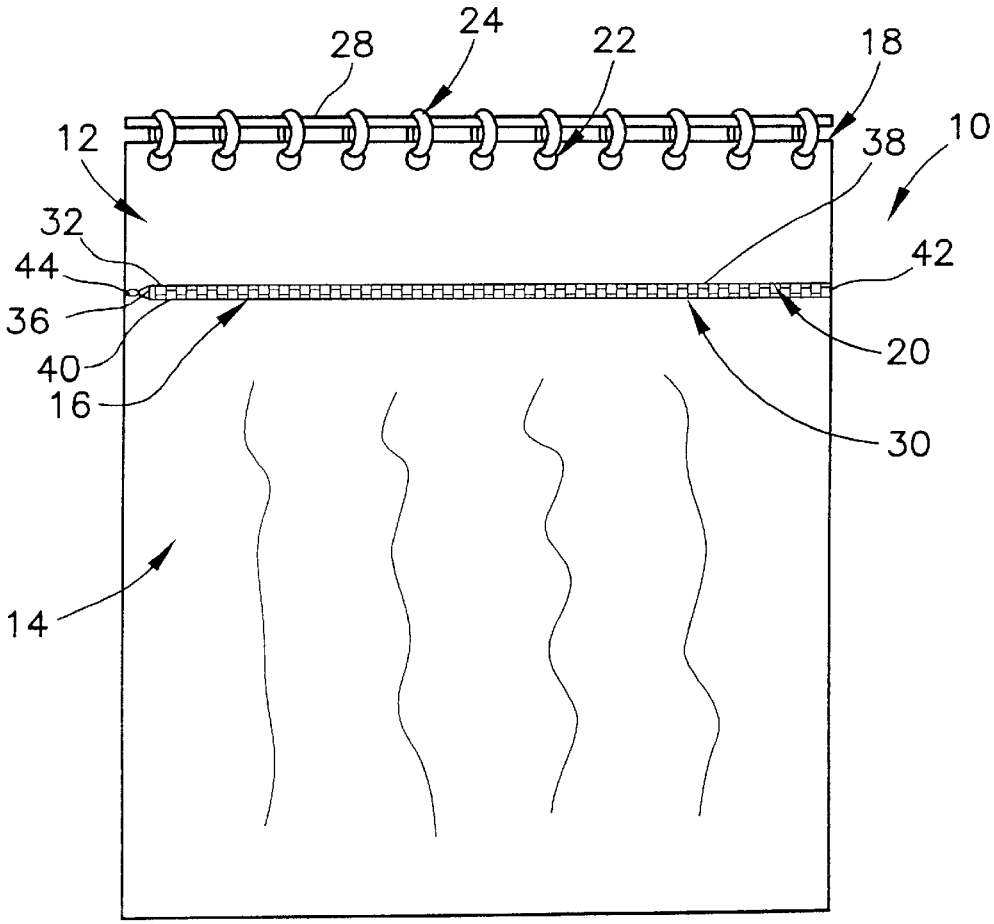
FIG. 1 illustrates a front view of the zippered shower curtain.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Referring to the drawings, FIG. 1 illustrates a zippered shower curtain generally as 10. The zippered shower curtain 10 in this preferred embodiment comprises a valance 12, a curtain 14, and a zipper 16.

In the preferred embodiment, a curtain 14 is removably attached to a valance 12 by a zipper 16. The valance 12 includes an upper edge 18, a lower edge 20, and a plurality of apertures 22. The plurality of apertures 22 are equidistantly spaced apart and located proximate to the upper edge 18 of the valance 12. The apertures 22 of the valance 12 accommodate rings 24 or S-hooks 26 (not shown) which pass through the apertures 22 of the valance 12 and suspend the valance 12 from a horizontally disposed rod 28 located in a shower stall or facility. The exact number of apertures 22 and rings 24 or S-hooks 26 is not of paramount importance, but it is common sensical that the number of apertures 22 should match the number of rings 24 or S-hooks 26 used therefor. In the preferred embodiment, the valance 12 is flexible and substantially rectangular in shape, and is generally commensurate in length with the length of the horizontally disposed rod 28.

The valance 12 could be made of cloth fabric, plastic, or plastic coated fabric. It is most preferable that the valance 12 comprise of a plastic or plastic coated cloth fabric material.

In the preferred embodiment, the curtain 14 includes an upper edge 30. In the preferred embodiment, the curtain 14 is flexible and substantially rectangular in shape and is generally commensurate in length with the length of the valance 12. The curtain 14 could be made of cloth fabric, plastic, or plastic coated cloth fabric. It is most preferable that the curtain 14 comprise of a plastic or plastic coated cloth fabric material. It is also preferable that the curtain 14 comprise of the same material as the valance 12.

Figure 2:
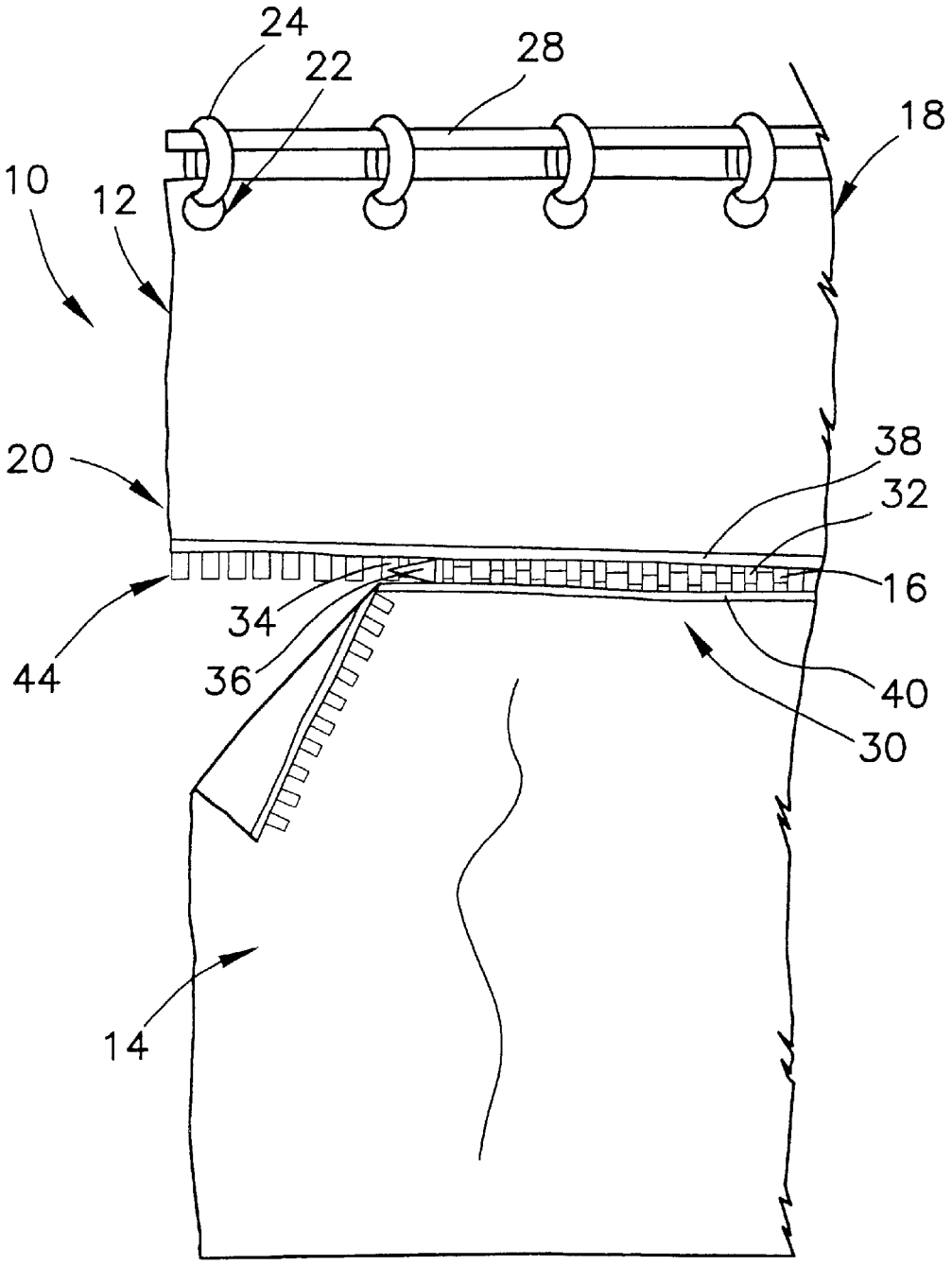
FIG. 2 illustrates an enlargement of an area of the zippered shower curtain as indicated in FIG. 1.

The zipper 16 includes a plurality of zipper teeth 32, a zipper slider 34, and a zipper slider pull tab 36. The zipper teeth 32 of the zipper 16 are attached to the valance 12 and to the curtain 14 by tapes 38, 40 (as shown in FIG. 2). The valance tape 38 affixes a plurality of zipper teeth 32 to the lower edge 20 of the valance 12. The curtain tape 40 affixes a plurality of zipper teeth 32 to the upper edge 30 of the curtain 14. The valance tape 38 is fixed in any suitable way to the lower edge 20 of the valance 12, while the curtain tape 40 is fixed in any suitable way to the upper edge 30 of the curtain 14. The zipper 16 is generally commensurate in length with the length of the valance 12 and the length of the curtain 14. The zipper 16 could be made of metal or plastic. It is most preferable that the zipper 16 comprise of a plastic substance.

Still referring to FIG. 2, the zipper slider pull tab 36 is pivotally connected to the zipper slider 34. The zipper teeth 32 are adapted to be moved to and from their interlocking positions by the displacement of the zipper slider 34 of the zipper 16. The zipper slider 38 engages and disengages the zipper teeth 32 by the pulling of the zipper slider pull tab 36 over the zipper teeth 32.

The curtain 14 is secured to the valance 12 by the engagement of the zipper teeth 32 of the zipper 16. The curtain 14 is attached to the valance 12 when the zipper teeth 32 of the zipper 16 are engaged. The zipper teeth 32 are engaged by pulling the zipper slider 34 by the zipper slider pull tab 36 from the start edge 42 of the zippered shower curtain 10 towards the stop edge 44 of the zippered shower curtain 10. As the zipper slider 34 passes over the zipper teeth 32, it engages the zipper teeth 32. Once the zipper slider 34 reaches the stop edge 44 of the zipper 16, the zipper teeth 32 are fully engaged, attaching the curtain 14 to the valance 12.

The curtain 14 is removed from the valance 12 by the disengagement of the zipper teeth 32 of the zipper 16. The curtain 14 is detached from the valance 12 when the zipper teeth 32 of the zipper 16 are disengaged. The zipper teeth 32 are disengaged by pulling the zipper slider 34 by the zipper slider pull tab 36 from the stop edge 44 of the zippered shower curtain 10 towards the start edge 42 of the zippered shower curtain 10. As the zipper slider 34 passes over the zipper teeth 32, it disengages the zipper teeth 32. Once the zipper slider 34 reaches the start edge 42 of the zipper 16, the zipper teeth 32 are fully disengaged, detaching the curtain 14 from the valance 12.

Once the curtain 14 is attached to the valance 12 to form the zippered shower curtain 10, as shown in FIG. 1, its novel advantages will become apparent. For one, the curtain 14 is easily removable from and attachable to the valance 14 for replacement or cleaning of the curtain 14. The zipper teeth 32 of the zipper 16 are more securely engaged than hook and loop material, preventing the accidental removal of the curtain 14 from the valance 12. The zipper 16 is stronger and more secure than hook and loop material.

The zippered shower curtain can be suspended from a horizontally disposed rod in a shower stall or facility without requiring apertures or rings or hooks in the curtain for attaching the curtain to the rod. This extends the life of the curtain by eliminating torn apertures which can result from the hanging or removal of the curtain. Another advantage of the zippered shower curtain is the uncomplicated removal of the curtain for cleaning. Persons with arthritis can more easily attach and remove the curtain without pain. This would be beneficial for use in hospitals or nursing homes.

While the invention has been described in connection with a preferred embodiment and several alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The foregoing discussion is illustrative of the invention. However, since many embodiments of the invention can be made without departing from the spirit and scope of the invention, the invention resides wholly in the claims hereinafter appended.

I claim:

1. A zippered shower curtain adapted to be supported on a horizontally disposed rod with a plurality of attachment means, the zippered shower curtain comprising:

a. a substantially rectangular valance, said valance having an upper edge, a lower edge, and a plurality of spaced apart apertures substantially proximate to said upper edge of said valance;

b. a curtain substantially rectangular in shape and generally commensurate in length with the length of said valance, said curtain having an upper edge; and c. a zipper generally commensurate in length with the length of said valance and the length of said curtain, said zipper having a plurality of zipper teeth, said zipper teeth being fixedly disposed in cooperative engagement between said lower edge of said valance and said upper edge of said curtain, whereby said valance is adapted to be attached to said rod by said attachment means which passes through said plurality of apertures of said valance, and said upper edge of said curtain is removably attached to said lower edge of said valance by the engagement of said zipper teeth of said zipper.

2. A zippered shower curtain comprising:

a. a substantially rectangular valance, said valance having an upper edge and a lower edge;

b. a curtain substantially rectangular in shape and generally commensurate in length with the length of said valance said curtain having an upper edge; and c. a zipper generally commensurate in length with the length of said valance and the length of the curtain, said zipper having a plurality of zipper teeth, said zipper teeth being fixedly disposed in cooperative engagement between said lower edge of said valance and said upper edge of said curtain, whereby said upper edge of said curtain is removably attached to said lower edge of said valance by the engagement of said zipper teeth of said zipper.

* * * * *